US010772366B1

(12) United States Patent
Ngan

(10) Patent No.: US 10,772,366 B1
(45) Date of Patent: Sep. 15, 2020

(54) CONVERTIBLE GARMENT

(71) Applicant: Shun On John Ngan, Carson, CA (US)

(72) Inventor: Shun On John Ngan, Carson, CA (US)

( * ) Notice: Subject to any disclaimer, the term of this patent is extended or adjusted under 35 U.S.C. 154(b) by 0 days.

(21) Appl. No.: 16/820,571

(22) Filed: Mar. 16, 2020

(51) Int. Cl.
*A41D 15/04* (2006.01)
*A41D 3/02* (2006.01)
*A41D 1/04* (2006.01)

(52) U.S. Cl.
CPC ..... *A41D 15/04* (2013.01); *A41D 1/04* (2013.01); *A41D 3/02* (2013.01); *A41D 2400/422* (2013.01)

(58) Field of Classification Search
CPC ..... A41D 2400/422; A41D 15/04; A41D 13/0012; A41D 27/20; A41D 27/201; A41D 1/04; A41D 3/02; A41D 3/04; A41D 3/08; A41D 15/00; A45C 3/14
USPC ..... 2/94, 66
See application file for complete search history.

(56) References Cited

U.S. PATENT DOCUMENTS 1,097,530 A 5/1914 Cabelinsky
1,243,206 A 10/1917 Norman
1,432,249 A 10/1922 Robert
1,643,440 A * 9/1927 Baldwin ..... A41D 15/04 2/84
1,905,235 A * 4/1933 Mandelert ..... A41D 27/20 2/94
D108,875 S 3/1938 Friedman
D113,194 S 1/1939 Storey et al.
2,143,931 A * 1/1939 Aronson ..... A41D 3/00 2/93
2,260,427 A * 10/1941 Bailey ..... A41D 15/002 2/94
2,292,347 A * 8/1942 Bailey ..... A41D 15/00 2/93
2,372,110 A 3/1945 Noone
2,420,344 A * 5/1947 Alexander ..... A47G 9/064 2/69
2,865,025 A * 12/1958 Hennessey ..... A41D 13/0012 2/94

(Continued)

FOREIGN PATENT DOCUMENTS

CA 2720578 11/2010
CA 144154 11/2013

(Continued)

OTHER PUBLICATIONS

Open Road Goods; Open Road Goods Surf Poncho/Adult Hooded Towel/Changing Towel/Wetsuit Changing Robe/Swim Parka—Changing Poncho Charcoal Black/Indigo Blue; Saves a Sea Turtle's Life; https://www.amazon.com/Poncho-Adult-Hooded-Changing-Wetsult/dp/B07BMR3KJ7/ref=sr_1_10?crid=2T0RU5Y9DSGSP&keywords=surf+poncho&qid=1576195319&sprefix=surf+p%2Caps%2C195&sr=8-10, 8 pages.

(Continued)

*Primary Examiner* — Amy Vanatta
(74) *Attorney, Agent, or Firm* — Cislo & Thomas, LLP

(57) ABSTRACT

A convertible garment have a pocket on a front side of the garment, the pocket having a first opening on a first lateral side of the pocket, a second opening on the second lateral side of the pocket, and a third opening on the top side or bottom side of the pocket, and a fastener to close the third opening. The pocket can be turned inside-out and the body of the garment stuffed inside the pocket to form a cushion configuration while still allowing access to the first and second openings.

4 Claims, 8 Drawing Sheets

(56) References Cited

U.S. PATENT DOCUMENTS 2,873,449 A * 2/1959 Herbert ..... A01M 31/006 2/94
2,967,306 A * 1/1961 Fabanich ..... A41D 3/08 2/94
3,079,611 A 3/1963 Boryszewski
D196,096 S 8/1963 Griffith et al.
3,116,491 A 1/1964 Previdi et al.
3,381,306 A 5/1968 Innes
D225,489 S 12/1972 Graham
3,797,043 A * 3/1974 Brument ..... A41D 15/04 2/69.5
3,837,006 A 9/1974 Laseman
4,055,853 A 11/1977 Argento et al.
D247,331 S 2/1978 Nally
D247,526 S 3/1978 Nally
4,078,264 A 3/1978 DeGennaro
4,227,264 A 10/1980 Spector et al.
4,370,755 A 2/1983 Crumby
4,404,687 A 9/1983 Hager
4,502,155 A * 3/1985 Itoi ..... A41D 3/00 2/115
D294,535 S 3/1988 Stricklin
D296,605 S 7/1988 Asher
4,791,681 A 12/1988 Dean
4,862,519 A * 9/1989 Bull ..... A45C 1/04 2/66
4,928,321 A 5/1990 Dobson
D312,721 S 12/1990 Shea
5,086,516 A * 2/1992 Baxter ..... A41D 1/02 2/102
D325,459 S 4/1992 Keever
5,119,510 A 6/1992 Schilling
5,206,957 A 5/1993 Gulick
D351,712 S 10/1994 Jackson
D365,193 S 12/1995 Dodd, Jr.
D385,088 S 10/1997 Handysides
5,697,102 A 12/1997 Benjamin
5,720,043 A 2/1998 White
5,787,504 A * 8/1998 Wu ..... A41D 15/04 2/93
5,850,634 A * 12/1998 Toombs ..... A41D 15/04 2/93
D414,013 S 9/1999 Group
5,996,121 A 12/1999 Harris
6,006,356 A 12/1999 Song
6,014,772 A 1/2000 Connelly
D430,721 S 9/2000 Beauchan
6,185,743 B1 2/2001 Mick
D439,029 S 3/2001 Goldman
6,219,847 B1 4/2001 Aikins
6,253,381 B1 7/2001 Kelley
6,275,993 B1 8/2001 McCarley
D453,607 S 2/2002 Tracy
6,405,377 B1 6/2002 Davis
D465,317 S 11/2002 Darling
D478,708 S 8/2003 Miros et al.
D482,935 S 12/2003 Yamane
6,760,921 B1 7/2004 Simmons
D496,144 S 9/2004 Bourget
6,839,911 B1 1/2005 Mathews
6,848,118 B2 2/2005 Barnes et al.
D507,693 S 7/2005 Walton
6,922,848 B1 8/2005 Stanley
7,065,810 B2 6/2006 Robinson
D541,011 S 4/2007 Day et al.
D551,429 S 9/2007 Wager
D553,329 S 10/2007 Wager
D553,330 S 10/2007 Wager
D565,456 S 4/2008 Anderson et al.
7,418,740 B2 9/2008 Anderson et al.
D584,482 S 1/2009 Marsh
D590,133 S 4/2009 Rogondino
D591,028 S 4/2009 Rogondino
D594,633 S 6/2009 Floyd
D600,884 S 9/2009 Patton
D601,327 S 10/2009 Anderson et al.
D608,983 S 2/2010 Myers
D609,432 S 2/2010 Jennings
D626,310 S 11/2010 Cruz
D626,720 S 11/2010 Pinkhasov
D626,725 S 11/2010 Snyder et al.
D627,540 S 11/2010 Claeys
D629,590 S 12/2010 Freedman et al.
D630,002 S 1/2011 Brown
D630,003 S 1/2011 Brown
D630,820 S 1/2011 Wilson
D636,973 S 5/2011 Smith et al.
D638,612 S 5/2011 Benderradji
D645,645 S 9/2011 Dyer
D653,836 S 2/2012 Woyshner et al.
D663,105 S 7/2012 Selivon
D672,531 S 12/2012 Kelfer
D674,167 S 1/2013 Ehler
D677,859 S 3/2013 Andes
D677,860 S 3/2013 Kim
D679,479 S 4/2013 Carrera et al.
D679,484 S 4/2013 Brown
8,424,113 B2 4/2013 Sprole
8,424,114 B2 4/2013 Snyder et al.
D683,523 S 6/2013 Freedman
D684,341 S 6/2013 Freedman
D684,409 S 6/2013 Juarez
D686,408 S 7/2013 Stemlight
D687,210 S 8/2013 Krafnick
D690,078 S 9/2013 Anderson
D690,486 S 10/2013 Yan
D692,212 S 10/2013 Coward
8,566,963 B2 10/2013 Ryan
D693,540 S 11/2013 Vanneste
D693,541 S 11/2013 Vanneste
8,578,515 B1 11/2013 Petersen
D701,677 S 4/2014 Tref
D707,466 S 6/2014 Lancaster
D708,423 S 7/2014 Adams et al.
D714,021 S 9/2014 Bowen
D714,524 S 10/2014 Borovicka
8,864,544 B2 10/2014 Anderman et al.
D721,467 S 1/2015 Tref
D728,900 S 5/2015 White
D732,800 S 6/2015 Brown
D736,496 S 8/2015 Gonzalez
D741,567 S 10/2015 Chang
D741,576 S 10/2015 Sakosits
D746,551 S 1/2016 Ingram
D747,075 S 1/2016 Ingram
D751,272 S 3/2016 Moehring
9,295,292 B2 3/2016 Sachs
D754,947 S 5/2016 Borovicka
9,339,064 B2 5/2016 Oliver
D758,046 S 6/2016 Grant
D758,700 S 6/2016 Borovicka
D762,345 S 8/2016 Adams et al.
9,414,631 B2 8/2016 Schrirnof
D765,349 S 9/2016 Hou
D765,351 S 9/2016 Shaw
D767,255 S 9/2016 Marino
D769,580 S 10/2016 Conway et al.
D770,136 S 11/2016 Darmour
9,554,601 B2 1/2017 Arajakis
70,020,215 1/2017 Merritt
D784,659 S 4/2017 Darmour
D785,285 S 5/2017 Shamsid-Deen
D785,906 S 5/2017 Darmour
D787,160 S 5/2017 Crowe et al.
D790,809 S 7/2017 Lomax
D792,678 S 7/2017 Storlie et al.
9,713,352 B2 7/2017 Demarest
D801,005 S 10/2017 Perez
9,775,387 B2 10/2017 Parr
D801,948 S 11/2017 Picunko
D802,884 S 11/2017 Bennett
D802,886 S 11/2017 Saice, Jr. et al.
D809,745 S 2/2018 Crowe et al.

(56) References Cited

U.S. PATENT DOCUMENTS

| | | | | |
|---|---|---|---|---|
| D810,401 | S | 2/2018 | Darmour | |
| D810,402 | S | 2/2018 | Darmour | |
| D811,051 | S | 2/2018 | Darmour et al. | |
| D815,801 | S | 4/2018 | Torre | |
| D820,560 | S | 6/2018 | Reynolds et al. | |
| D822,344 | S | 7/2018 | Karim | |
| D827,247 | S | 9/2018 | Genender | |
| D827,248 | S | 9/2018 | Genender | |
| D827,249 | S | 9/2018 | Darmour et al. | |
| 10,080,391 | B2 | 9/2018 | Rundle | |
| D830,735 | S | 10/2018 | Johnson | |
| D831,937 | S | 10/2018 | James | |
| 10,130,126 | B2 | 11/2018 | Blauser | |
| D839,539 | S | 2/2019 | Jones | |
| D839,546 | S | 2/2019 | Noiberg | |
| D840,133 | S | 2/2019 | Peck | |
| D841,289 | S | 2/2019 | Frost et al. | |
| D842,589 | S | 3/2019 | Johnson | |
| 10,265,636 | B2 | 4/2019 | Anderman et al. | |
| D854,787 | S | 7/2019 | Ngan | |
| D856,032 | S | 8/2019 | Hindley | |
| D859,788 | S | 9/2019 | Speciale et al. | |
| 10,420,431 | B1 | 9/2019 | Speciale et al. | |
| D862,841 | S | 10/2019 | Lomax | |
| D862,843 | S | 10/2019 | Darmour | |
| D862,845 | S | 10/2019 | Plant et al. | |
| 10,485,278 | B2 | 11/2019 | Noll et al. | |
| D886,416 | S | 6/2020 | Speciale | |
| 2001/0032360 | A1 | 10/2001 | Bertrand | |
| 2002/0142112 | A1 | 10/2002 | Tarrell | |
| 2003/0061659 | A1 | 4/2003 | Dunlap | |
| 2003/0182714 | A1* | 10/2003 | Mariland | A41D 13/0015 2/247 |
| 2004/0181844 | A1 | 9/2004 | Kim | |
| 2004/0237167 | A1 | 12/2004 | Curry | |
| 2005/0144695 | A1* | 7/2005 | Aldridge | A41D 31/085 2/69 |
| 2006/0010555 | A1 | 1/2006 | Hayes | |
| 2007/0050882 | A1 | 3/2007 | Eisenhuth | |
| 2007/0061940 | A1 | 3/2007 | Cazares | |
| 2007/0083983 | A1 | 4/2007 | Barclay | |
| 2007/0157359 | A1 | 7/2007 | Reardon et al. | |
| 2007/0266473 | A1 | 11/2007 | Issel | |
| 2008/0056508 | A1 | 3/2008 | Pierce et al. | |
| 2008/0120774 | A1 | 5/2008 | Hite | |
| 2008/0196140 | A1 | 8/2008 | Mayerson | |
| 2008/0209612 | A1* | 9/2008 | Summers | A41D 3/08 2/84 |
| 2008/0250560 | A1 | 10/2008 | Armstrong | |
| 2009/0055991 | A1 | 3/2009 | Johnson et al. | |
| 2009/0144874 | A1 | 6/2009 | Stein | |
| 2009/0165206 | A1 | 7/2009 | Davis | |
| 2009/0205117 | A1 | 8/2009 | Day et al. | |
| 2009/0229034 | A1 | 9/2009 | Zmigrosky | |
| 2009/0235426 | A1 | 9/2009 | Johnston et al. | |
| 2010/0115684 | A1 | 5/2010 | Freedman et al. | |
| 2010/0122395 | A1 | 5/2010 | Wall et al. | |
| 2010/0146680 | A1 | 6/2010 | Cuoco | |
| 2010/0186166 | A1 | 7/2010 | Sulentic | |
| 2011/0179559 | A1 | 7/2011 | Smoot | |
| 2011/0185471 | A1 | 8/2011 | Buczkowski | |
| 2011/0206299 | A1 | 8/2011 | Carmody | |
| 2012/0005802 | A1 | 1/2012 | Claeys | |
| 2012/0023635 | A1 | 2/2012 | Ehler | |
| 2012/0060254 | A1 | 3/2012 | Blade | |
| 2012/0144550 | A1 | 6/2012 | Nejad | |
| 2013/0000010 | A1 | 1/2013 | Ryan | |
| 2013/0019378 | A1 | 1/2013 | White | |
| 2013/0042383 | A1 | 2/2013 | Ryan et al. | |
| 2013/0130540 | A1 | 5/2013 | Oman et al. | |
| 2013/0152269 | A1 | 6/2013 | Coward | |
| 2013/0152270 | A1 | 6/2013 | Neal et al. | |
| 2013/0219581 | A1 | 8/2013 | Schrimpf | |
| 2013/0219616 | A1 | 8/2013 | Bozek | |
| 2013/0269082 | A1 | 10/2013 | Bramblet | |
| 2014/0068834 | A1 | 3/2014 | Skinner | |
| 2014/0082818 | A1 | 3/2014 | Nysheva-Starr | |
| 2014/0096305 | A1 | 4/2014 | Friesen | |
| 2014/0215689 | A1 | 8/2014 | Perez | |
| 2014/0237700 | A1 | 8/2014 | Albert | |
| 2014/0259275 | A1 | 9/2014 | Walvius et al. | |
| 2014/0310848 | A1 | 10/2014 | Ulriksen | |
| 2014/0317824 | A1 | 10/2014 | Browning et al. | |
| 2014/0331381 | A1 | 11/2014 | Arajakis | |
| 2015/0121604 | A1 | 5/2015 | Lee et al. | |
| 2015/0135397 | A1 | 5/2015 | Levine | |
| 2015/0150319 | A1 | 6/2015 | Walmsley | |
| 2015/0196061 | A1 | 7/2015 | Oliver | |
| 2015/0250337 | A1 | 9/2015 | Gould | |
| 2015/0296898 | A1 | 10/2015 | Bowen | |
| 2015/0296909 | A1* | 10/2015 | Sachs | A41B 1/08 2/84 |
| 2016/0157535 | A1 | 6/2016 | Tirro et al. | |
| 2016/0174633 | A1 | 6/2016 | Macrae | |
| 2016/0242474 | A1 | 8/2016 | Baschak | |
| 2016/0309799 | A1 | 10/2016 | Nysheva-Starr | |
| 2017/0020215 | A1 | 1/2017 | Merritt | |
| 2017/0079350 | A1 | 3/2017 | Hourani | |
| 2017/0164665 | A1 | 6/2017 | Johnson | |
| 2017/0224030 | A1 | 8/2017 | Olivares Velasco | |
| 2017/0224033 | A1* | 8/2017 | Latta, Jr. | A41D 1/04 |
| 2017/0265545 | A1 | 9/2017 | Peng | |
| 2017/0280793 | A1 | 10/2017 | Reyes | |
| 2017/0311655 | A1 | 11/2017 | Gonzalez | |
| 2018/0027889 | A1 | 2/2018 | Frost et al. | |
| 2018/0049489 | A1* | 2/2018 | Noll | A41D 27/20 |
| 2018/0092410 | A1 | 4/2018 | Rundle | |
| 2018/0368496 | A1 | 12/2018 | Berrebi | |
| 2019/0142089 | A1 | 5/2019 | Emes | |
| 2019/0216191 | A1* | 7/2019 | Botha | A61F 7/02 |
| 2019/0254410 | A1 | 8/2019 | DuVall | |
| 2019/0269184 | A1 | 9/2019 | Gracie | |
| 2020/0008500 | A1 | 1/2020 | Speciale | |

FOREIGN PATENT DOCUMENTS

| | | | | |
|---|---|---|---|---|
| DM | 091998 | | 10/2016 | |
| GB | 2551262 | | 12/2017 | |
| JP | 1046408 | | 2/1998 | |
| JP | 2006207103 | | 8/2006 | |
| NL | 9302143 | A * | 7/1995 | A41D 3/06 |
| WO | WO 2018222868 | | 6/2018 | |

OTHER PUBLICATIONS

Koretemp Poncho Liner posted to bushcraftoutfitters.corn, Available date Jul. 17, 2019 [site visited Mar. 20, 2020]. Available: https://bushcraftoutfitters.com/koretemp-poncho-liner/> (Year: 2019).

Ho Stevie! Surf Poncho posted to amazon.com. Available date: Mar. 19, 2016 [site visited Mar. 20, 2020]. Available: <https:// www.amazon.com/Ho-Stevie-Microfiber-Wetsuit-Changing/dp/B01CV1P9UG/ref=cm_cr_arp_d_product_top?le=UTF8> (Year: 2016).

* cited by examiner

CONVERTIBLE GARMENT

TECHNICAL FIELD

This invention relates to garments.

BACKGROUND

There are many garments that are worn as external shells. Oftentimes a user may want to remove the external shell, but carrying the external shell can be annoying because the user does not want portions of the garment to drag on the ground. As such, some garments are designed with an auxiliary pocket such that the garment can be stuffed inside the auxiliary pocket to form a small package. The small package can be easily carried around. As such, this concept is generally limited to thin wind breaker type jackets.

The wind breaker is generally made of a thin nylon material. The auxiliary pockets are sized to be able to pack the wind breaker into the smallest package possible. As such, the package size tends to be about the size of a person's hand. These packages can then be stuffed inside a person's pocket or purse so as to be easily carried around. However, as a small package, the package does not have much other functional use.

Oftentimes, users bunch up their garments to form a fluffy cushion of sorts. However, the garment tends to unravel and lose its fluffiness because nothing keeps in bound in the cushion configuration.

For the foregoing reasons there is a need for a garment that can be converted into a cushion configuration that is large enough to use as a cushion or a pillow and maintain its fluffiness and cushion configuration during use.

SUMMARY

The present invention is directed to a garment that can be stuffed into its own pocket to form a cushion with hand-warming pockets still accessible. The garment can be a hoodie, jacket, vest, or other type of garment warn as an outer layer of clothing, such as the shell layer. A pocket is formed on the front side of the garment with two side openings for insertion of the user's hands. A third opening, preferably located at the bottom of the pocket, is formed with a fastener to close the opening. When the garment is worn, the fastener is closed and the pocket functions as a standard pocket.

To convert the garment into a cushion, the fastener is released to open the third opening. In the preferred embodiment, a handle is attached to the top side of the pocket on the inside. The user can reach into the pocket through the third opening, grab the handle and pull the handle out so that the pocket is turned inside-out. The remainder of the garment is stuffed back into the pocket to form a cushion. In addition, the pockets are still accessible for the user to insert his or her hands.

DETAILED DESCRIPTION OF THE INVENTION

Figure 1:
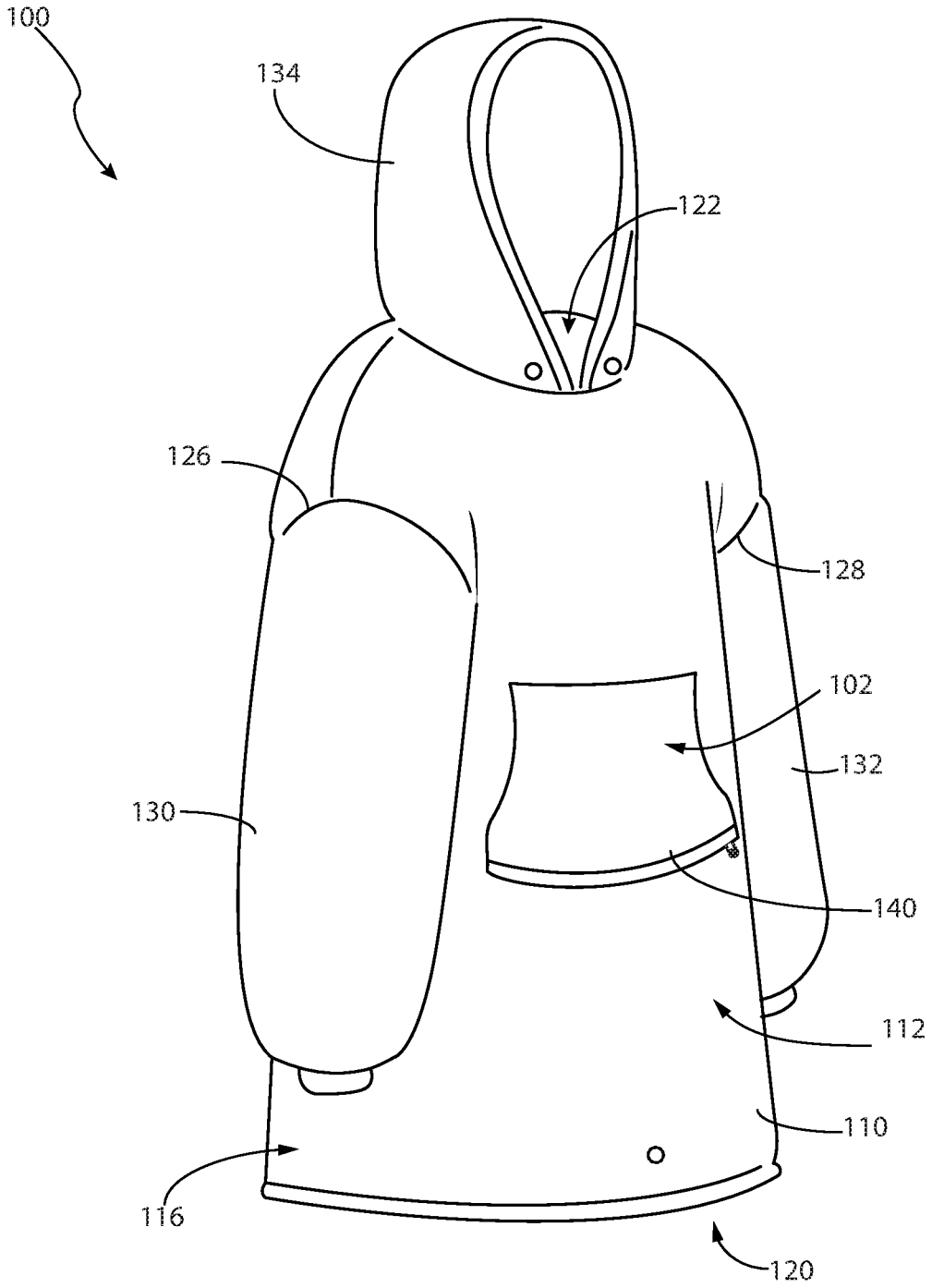
FIG. 1 shows a perspective view of an embodiment of the present invention.
Figure 2:
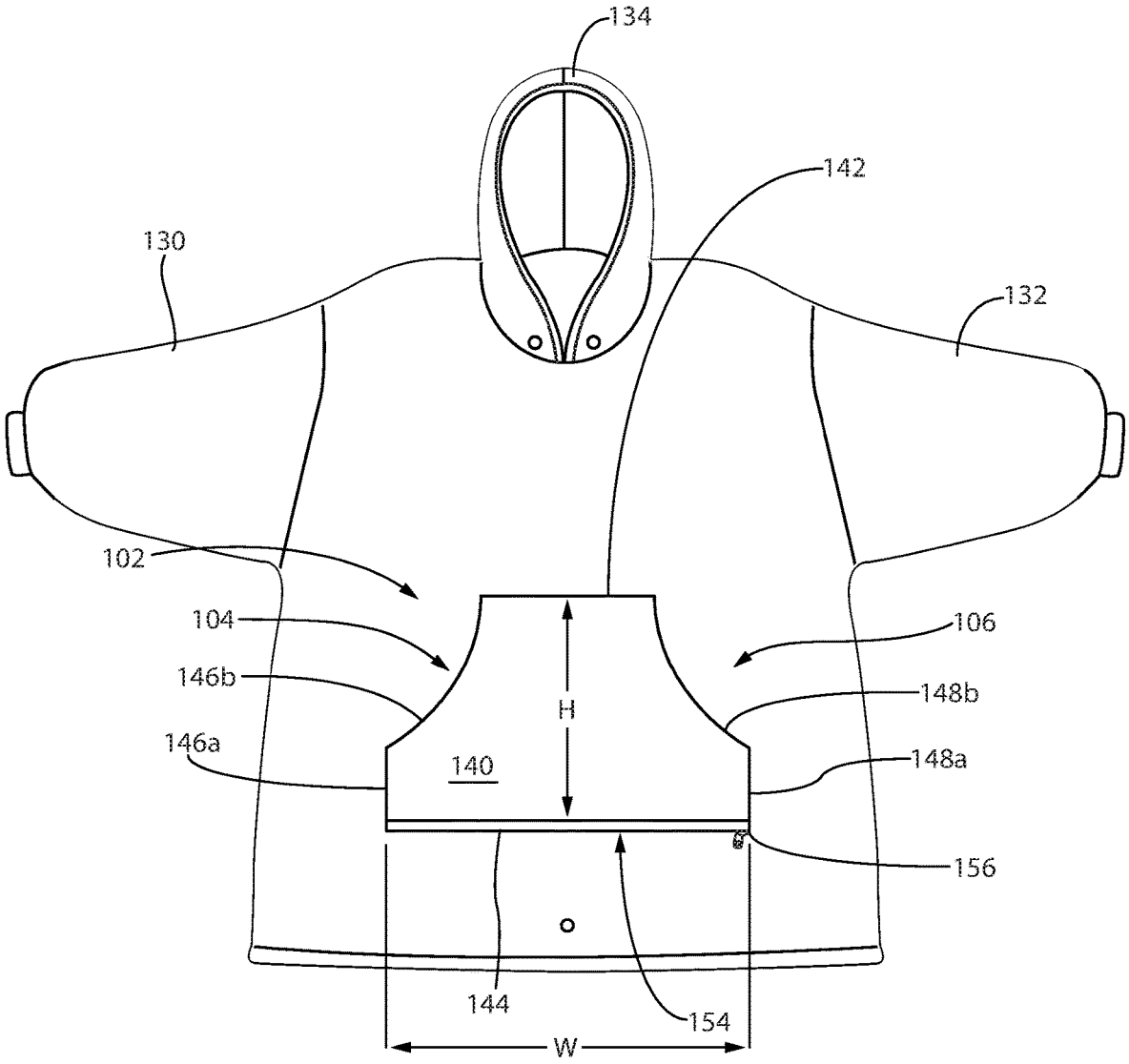
FIG. 2 shows a front view of the embodiment shown in FIG. 1.
Figure 3:
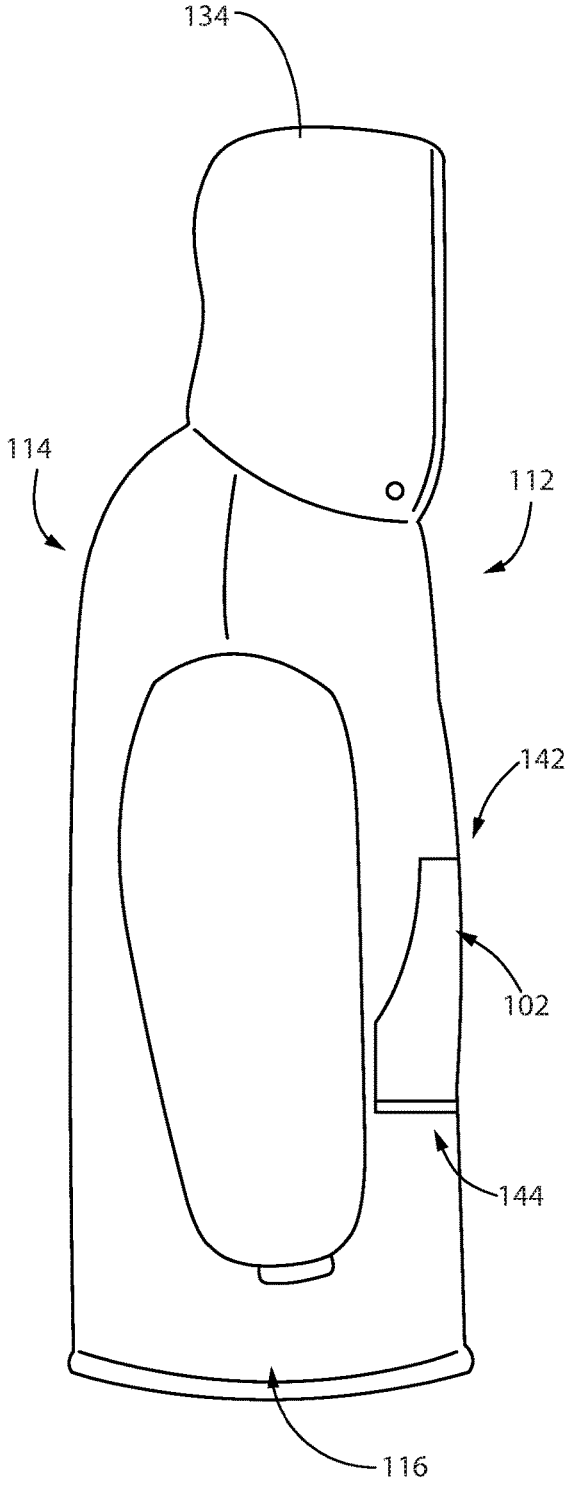
FIG. 3 shows a side view of the embodiment shown in FIG. 1.
Figure 4:
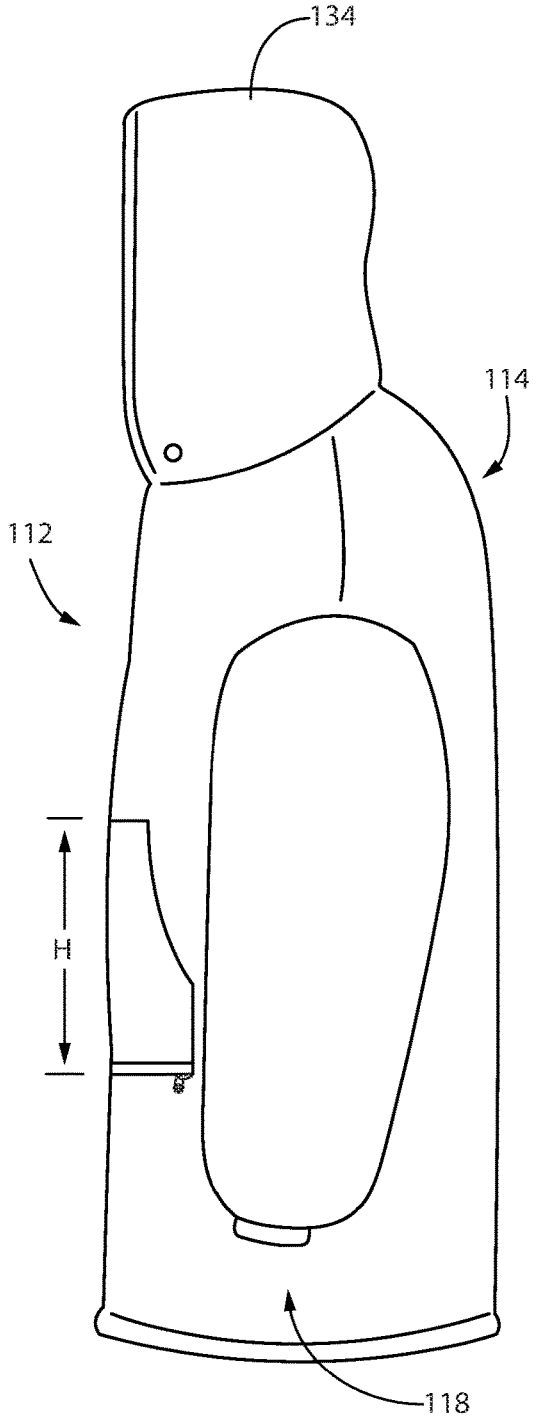
FIG. 4 shows another side view of the embodiment shown in FIG. 1.
Figure 5:
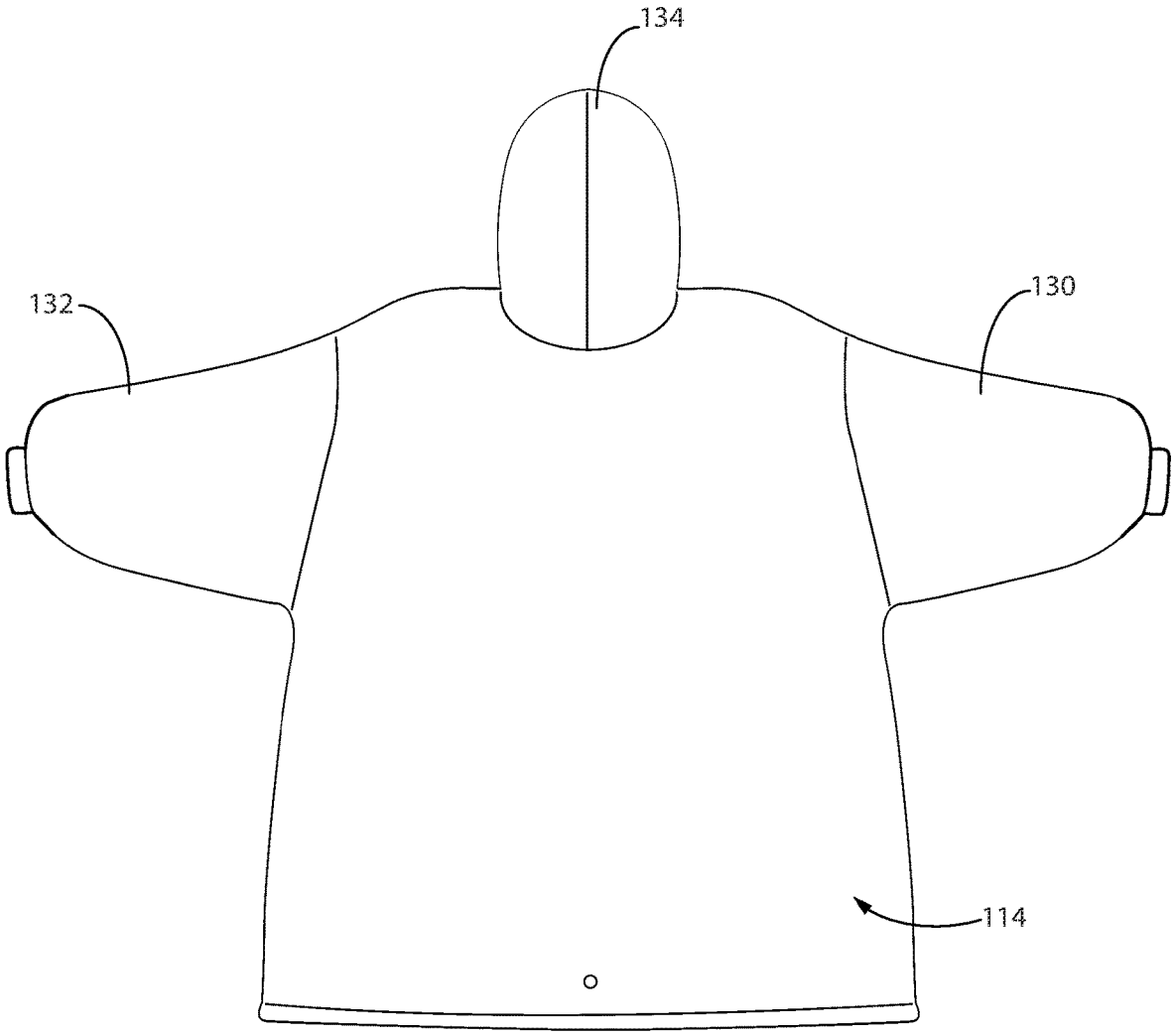
FIG. 5 shows a back view of the embodiment shown in FIG. 1.
Figure 6:
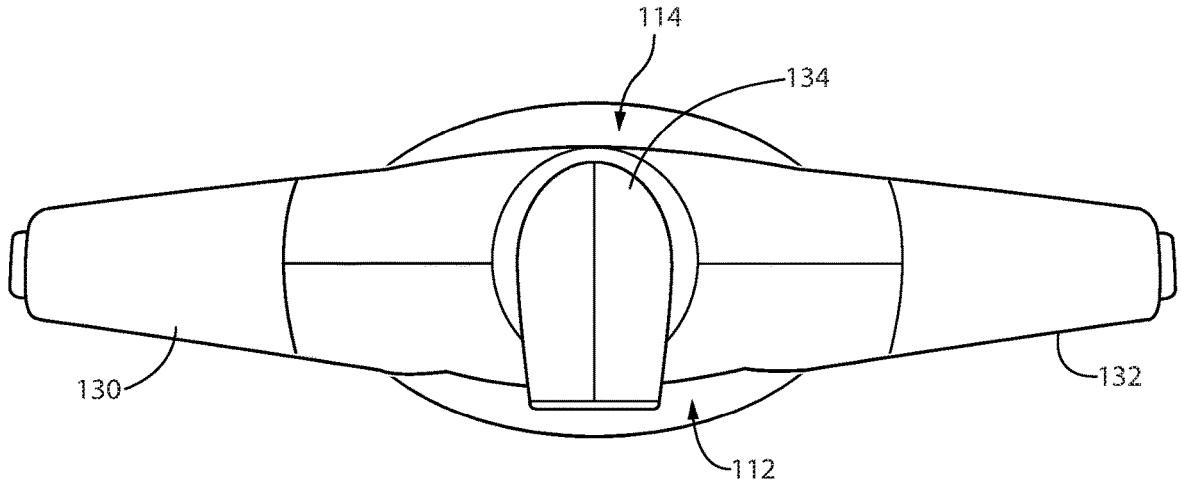
FIG. 6 shows a top view of the embodiment shown in FIG. 1.
Figure 7:
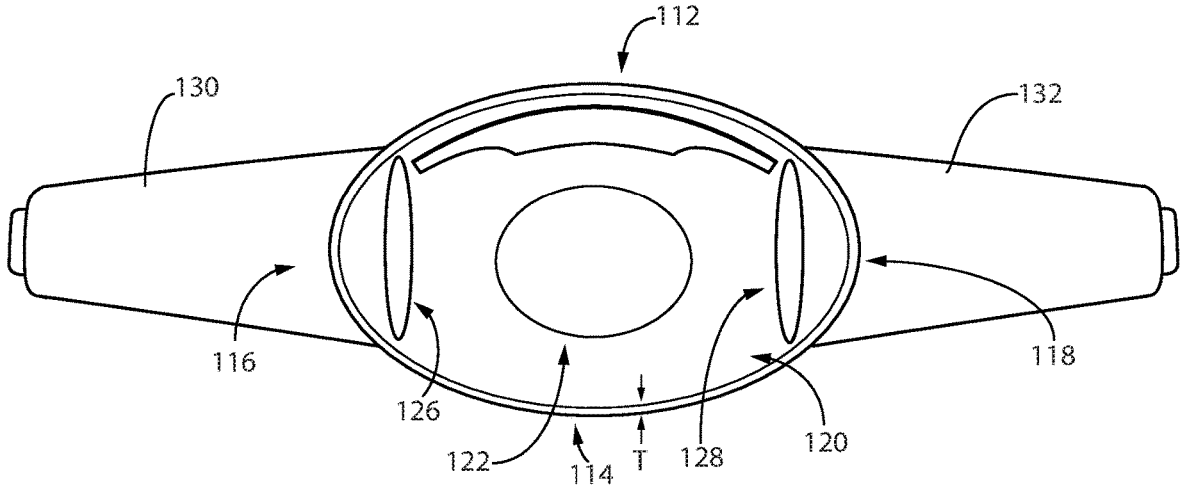
FIG. 7 shows a bottom view of the embodiment shown in FIG. 1.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention. Directional terms, such as top, bottom, front, back, sides, and the like are in reference to the invention properly worn by a user in a standing position in typical fashion of how garments are worn. Therefore, these terms are not intended to be limiting as the orientation of the invention can change, but rather are used for purposes of clarity and convenience.

With reference to FIGS. 1-7, the invention of the present application is directed towards a garment 100 having a pocket 102 that can be converted into a cushion configuration 200 by converting the pocket 102 inside-out while still allowing access to pocket openings 104, 106 so that the cushion configuration 200 has openings 104, 106 into which a user can insert his or her hands so that the cushion 200 (see FIG. 9) can be used as a hand-warmer.

The garment 100 can be a typical out garment worn during colder weather. As such, the garment 100 comprises a body 110 that covers the torso of the user. The body 110 comprises a front side 112 and a back side 114 opposite the front side 112. The body 110 further comprises a first side 116 and a second side 118 opposite the first side 116, typically in the area where the front side 112 and the back side 114 meet. The body 110 further comprises a bottom opening 120 through which the user can don the garment 100. The body 110 also comprises a top opening 122 through which the user's head exits when the garment 100 is donned. The body 110 also comprises a first arm hole 126 on the first side 116, and a second arm hole 128 on the second side 118 through which the arms of the user exit when the garment 100 is donned. Such an embodiment defines a vest.

In some embodiment, a first sleeve 130 can be attached to the first side 116 at the first arm hole 126, and a second sleeve 132 can be attached to the second side 118 at the second arm hole 128. The sleeves 130, 132 can be short-sleeves designed to cover a portion of the user's arms, or long-sleeves designed to cover substantially all or most of the user's arms. In some embodiments, a hood 134 can be attached to the body 110 at the top opening 122 to create a hoodie.

A patch 140 is attached to the front side 112 of the body 110. The patch 140 has a top side 142, a bottom side 144 opposite the top side 142, a first lateral side 146 adjacent to the top side 142 and the bottom side 144, and a second lateral side 148 opposite the first lateral side 146 and adjacent to the top side 142 and the bottom side 144. The top side 142, first lateral side 146, second lateral side 148, and bottom side 144 are attached to the front side 112 of the body 110 to define the pocket 102 in between the body 110 and the patch 140.

The first lateral side 146 defines a first opening 104, and the second lateral side 148 defines a second opening 106. The first and second openings 104, 106 can extend the full length of their respective lateral sides 146, 148 or only a portion thereof. The first and second openings 104, 106 allow the user access into the pocket 102 so that the user can insert his or her hands or various items into the pocket 102.

In some embodiments, the bottom side 144 defines a third opening 154, and comprises a fastener 156 to close the third opening 154. The fastener 156 can be a zipper, buttons, hook-and-loop fasteners, magnets, and the like.

In some embodiments, the top side 142 defines a fourth opening 176, and comprises a fastener 170 to close the fourth opening 176 like the third opening 154. The fastener 170 can be a zipper, buttons, hook-and-loop fasteners, magnets, and the like. Having an opening 176 on the top side allows the pocket 102 to be used like a pouch.

In some embodiments, the first and second openings 104, 106 can also be closeable with respective fasteners 172, 174, like the third opening 154. For example, the fasteners 172, 174 can be a zipper, buttons, hook-and-loop fasteners, magnets, and the like.

The critical aspect of the invention is that the patch 140 that defines the pocket 102 can have an opening at the top side 142 or the bottom side 144 to allow for the pocket 102 to be turned inside-out and have the body 110 of the garment 100 stuffed inside the pocket 102. In prior garments that can be stuffed into a pouch, the pouch is a separate structure fastened to the garment, but does not serve as the hand-warming pocket. As such, traditional pouches only have a single opening. Therefore, when the garment is stuffed into the pouch, and the pouch is zipped up at the opening, there is no longer any access to the interior of the pouch. Even if the opening of the pouch was not zipped up, it would only allow for one hand to be inserted comfortably.

By using the hand-warming pocket 102 located on the front side 112 of the body 110 as the pouch into which the body 110 can be stuffed, the garment 100 eliminates the need for an extraneous pouch generally located on the back of the garment. More importantly, the openings 104, 106 to the pocket 102 are still accessible even after the garment 100 has been stuffed into the pocket 102. This allows the user access to the pocket 102 from a natural and comfortable position so as to continue to use the hand-warming pocket 102 as a hand-warming pocket even after the garment 100 is converted into a cushion 200.

Preferably, the pocket 102 is positioned centrally on the front side 112 of the body so that the first opening 104 and the second opening 106 are symmetrically arranged on the front side 112 of the body. The first, second, and third openings 104, 106, 154 (and fourth opening 176, if any) all lead to the same main pocket 102. That main pocket 102, when turned inside-out, receives the entire body 110 of the garment 100. Therefore, sub-sections of the pocket 102 are not required.

Preferably, the garment 100 is an oversized hooded garment that is fluffy and warm so that when converted into a cushion 200, the cushion is soft and plush, while providing ample room for the hands. Because the entire body must fit inside the pocket 102, and the preferably embodiment is an oversized hooded garment, the pocket 102 must also be oversized so as to be capable of receiving the entire body 110, including the hood 134. For example, the pocket 102 can have a height H measured from the top side of the pocket 102 to the bottom side of the pocket 102 of approximately 8 inches to approximately 25 inches. Preferably, the height H of the pocket 102 is approximately 10 inches to approximately 20 inches. Most preferably, the height H of the pocket 102 is approximately 12 inches to approximately 18 inches. For example, the pocket 102 can have a height H of approximately 13 inches, 14 inches, 15 inches, 16 inches, or 17 inches.

The pocket 102 can have a width W of approximately 16 inches to approximately 35 inches. Preferably, the pocket 102 has a width W of approximately 18 inches to approximately 30 inches. More preferably, the pocket 102 has a width W of approximately 20 inches to approximately 26 inches. Most preferably, the pocket 102 has a width W of approximately 21 inches to 25 inches. For example, the width W can be 22 inches, 23 inches or 24 inches. As such, the pocket size and volume is larger than typical hand warming pockets for outwear.

In addition, because packaging the garment into a small package is not a concern, and use as a cushion is preferable, the body 110 can be thicker than typical garments than are packaged into small packages. In other words, the thickness T of the garment of the present invention can be greater than the thickness of a standard windbreaker. For example, the body 110 can have a thickness T of approximately 0.1 inch or greater. Preferably, the body 110 can have a thickness T of approximately 0.2 inch or greater. More preferably, the body 110 can have a thickness T of approximately 0.3 inch or greater. In some embodiments, the body 110 can have a thickness T of approximately 0.4 inch to 1 inch. Therefore, preferably material to use includes soft, fluffy, plush-type material, such as fleece, Sherpa, cotton, wool, and the like. However, thinner material can also be used, such as nylon, linen, rayon, polyester, and the like. In addition, any combination thereof is also suitable.

Due to the shape of the pocket 102, when the garment is converted into the cushion configuration 200, the cushion 200 forms a box-like shape having a length that is equivalent to the width W of the pocket 102 and a width that is equivalent to the height H of the pocket 102. As such, the cushion 200 can be used as a pillow to sleep on or sit on, but with the added advantage of having pockets that are accessible to keep the hands warm.

Figure 8:
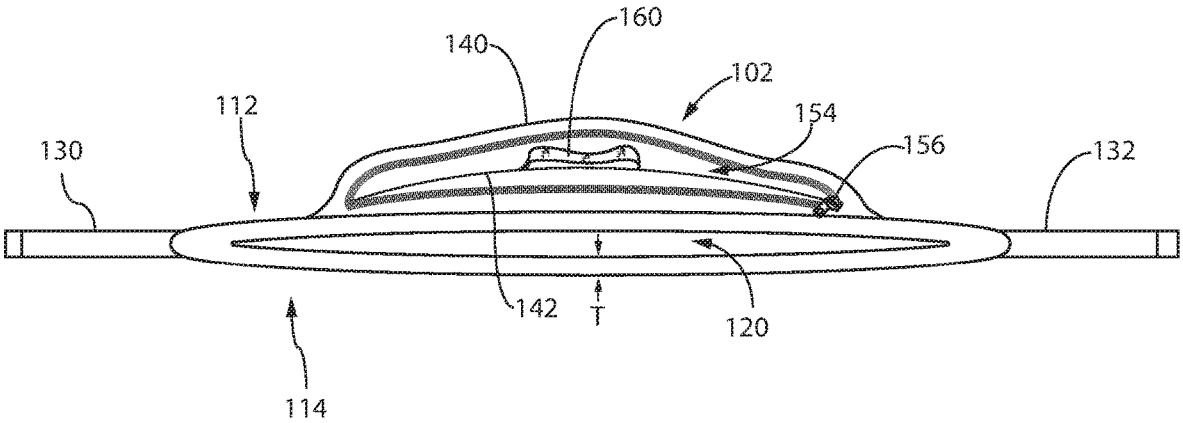
FIG. 8 shows another bottom view of an embodiment of the present invention with the pocket open from the bottom side.

With reference to FIG. 8, to facilitate the conversion of the garment 100 into a cushion configuration 200, the garment 100 can further comprise a handle 160 inside the pocket 102. Preferably, the handle 160 is located opposite the top opening or the bottom opening 154 of the pocket 102. For example, if the pocket 102 has a top opening 158, then the handle 160 is preferably adjacent to the bottom 144 of the pocket 102. If the pocket 102 has a bottom opening 154, then the handle 160 is preferably adjacent to the top 142 of the pocket 102.

In some embodiments, both the top 142 and bottom 144 of the pocket 102 may be openable and closeable. In such an embodiment, the garment 100 can have two handles 160, 178 on the inside of the pocket 102, one handle 160 adjacent to the top 142 and one handle 178 adjacent to the bottom 144. In this configuration, the user can choose which direction to stuff the body 110 into the pocket 102. i.e. through the top opening 158 of the pocket 102 or through the bottom opening 154 of the pocket 102.

By way of example only, in the preferred embodiment, the garment 100 has a front, hand-warming pocket 102 created by fastening a patch 140 on the front 112 of the body 110. The top 142 of the patch 140 can be permanently attached to the front 112 of the body 110 by stitching, for example. Lower portions of the two lateral sides 146*a*, 148*a* can also be permanently attached to the front 112 of the body 110 by stitching for example. This leaves upper lateral side portions 146*b*, 148*b*, one on each side, unattached to the front 112 of the body 110 thereby defining openings 104, 106 to access inside the pocket 102. The bottom side 144 of the pocket 102 has an opening 154 that can be closed with a fastener 156, such as a zipper.

In use, the user unfastens the bottom side 144 of the pocket 102 from the body 110 of the garment 100. In this example, the user unzips the bottom side 144 of the pocket 102 all the way to expose the opening 154 at the bottom side 144. The first lateral side 146, second lateral side 148, and top side 142 of the pocket 102 remain attached to the body 110 of the garment 100, except that the first lateral side 146 defines a first opening 104, and the second lateral side 148 defines a second opening 106 for access inside the pocket 102.

The user then turns the pocket 102 inside-out so that an interior of the pocket 102 defined by the patch 140 and the body 110 is exposed to the environment. In the preferred embodiment, this step can be accomplished by pulling on the handle 160 located at the top 142 of the pocket 102 to turn the pocket 102 inside-out, so that the interior of the pocket 102 is now exposed to the environment.

Figure 9:
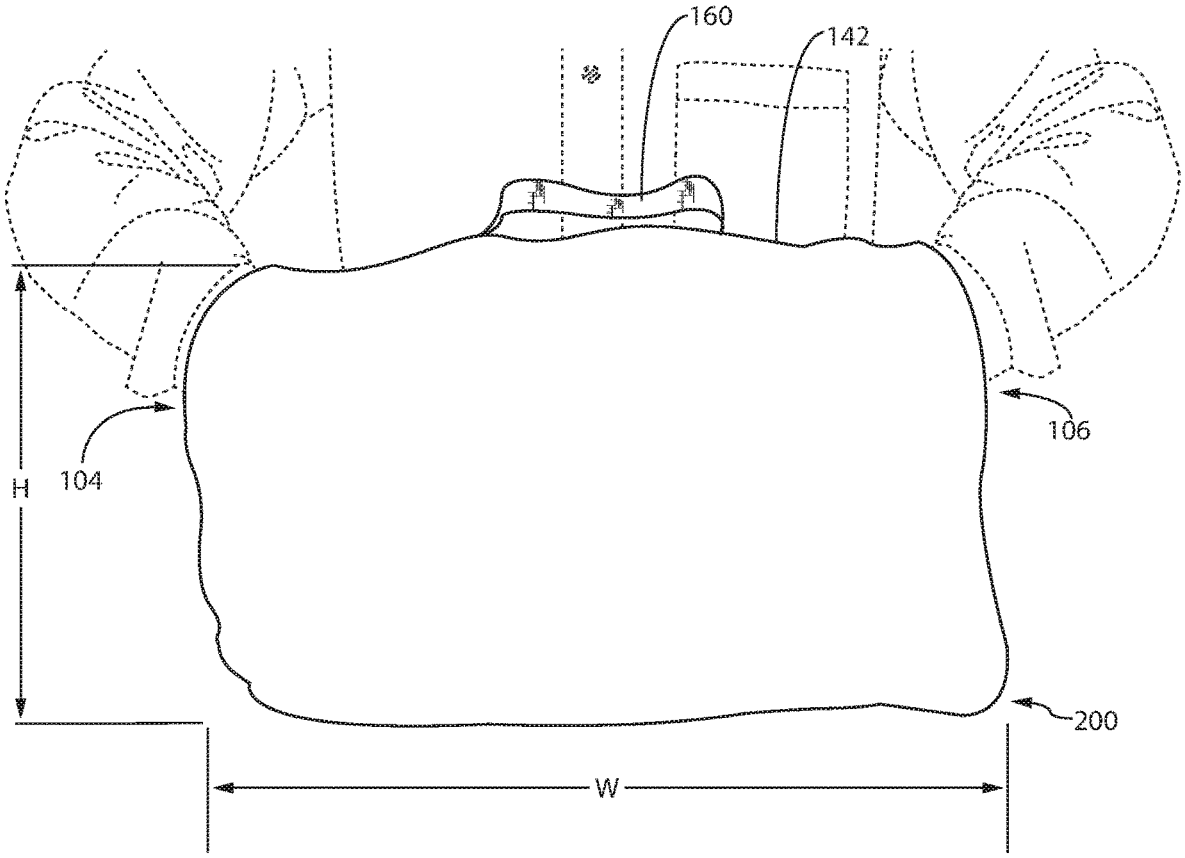
FIG. 9 shows the present invention converted into a cushion.
Figure 10:
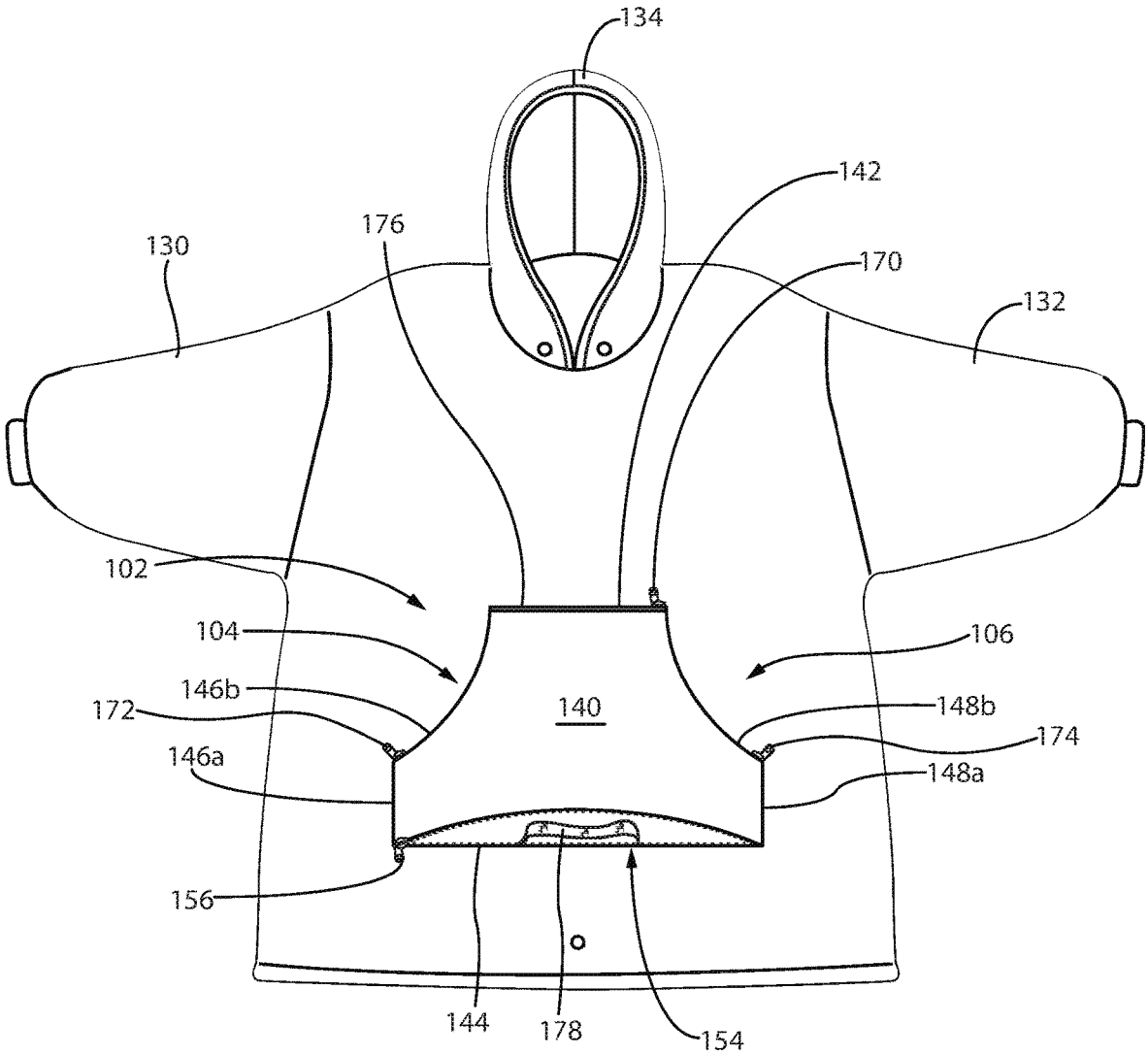
FIG. 10 shows a front view of another embodiment of the present invention.

Once the pocket 102 is turned inside-out, the user can stuff the body 110 of the garment 100 into the pocket 102 to convert the garment 100 into a cushion 200 (see FIG. 9). However, because the pocket 102 is used to receive the body 110, the first opening 104 and the second opening 106 are still accessible for receiving a user's hands. Therefore, a hand-warming cushion 200 is formed. Furthermore, because the pocket 102 is now inside-out, the handle 160 is now accessible from the outside. As such, the handle 160 can be used to carry the cushion 200 as well.

Having a bottom side opening 154 makes it easier to quickly stuff the body 110 into the pocket 102, particularly with the handle 160 adjacent to the top side 142 of the pocket 102 on the inside. In this configuration, when the user grabs the handle 160 inside the pocket 102, the user grabs approximately at the mid-point of the garment. When the handle 160 is pulled out of the pocket 102 and held above the rest of the body, the bottom 144 of the pocket 102 folds over and encompasses a portion of the body 110 with the remaining hanging underneath the inverted pocket 102, which is now taking on the form of a rectangular cushion 200. This configuration makes it very easy to stuff the remainder of the body 110 up into the inverted pocket 102 by rotating the cushion 200 so that the opening 154 is now at the top allowing the remainder of the body to settle into the pocket 102.

In some embodiments, the openings 104, 106 of the pocket 102 can be made closeable with a fastener 156. Therefore, one or both openings 104, 106 of the pocket 102 can be closed with respective fasteners, such as zippers, buttons, hook-and-loop fasteners, and the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A method of converting a garment into a hand-warming cushion, comprising:

a) unfastening a bottom side of a patch from a body of a garment, wherein a first lateral side, a second lateral side, and a top side of the patch remain attached to the body of the garment to define a pocket, wherein the first lateral side defines a first opening, and the second lateral side defines a second opening;

b) turning the pocket inside-out so that an interior of the pocket is exposed to the environment;

c) stuffing the body of the garment into the inside-out pocket to convert the garment into a cushion configuration, wherein the first opening and the second opening are accessible for receiving a user's hands, whereby the hand-warming cushion is formed.

2. The method of claim 1, wherein the step of turning the pocket inside out comprises pulling on a handle adjacent to the top side of the patch.

3. The method of claim 2, wherein the first opening is closeable with a first fastener.

4. The method of claim 3, wherein the second opening is closeable with a second fastener.

* * * * *